US005186663A

United States Patent [19]

Wymelenberg

[11] Patent Number: 5,186,663

[45] Date of Patent: Feb. 16, 1993

[54] ELECTRICAL FEMALE TERMINAL

[75] Inventor: Mark J. V. Wymelenberg, Hubbard, Ohio

[73] Assignee: General Motors Corporation, Detroit, Mich.

[21] Appl. No.: 914,703

[22] Filed: Mar. 23, 1992

[51] Int. Cl.[5] ..... H01R 13/87

[52] U.S. Cl. ..... 439/843; 439/851

[58] Field of Search ..... 439/842-845, 439/847, 848, 851-856, 861

[56] References Cited

U.S. PATENT DOCUMENTS

| | | | |
|---|---|---|---|
| 3,003,135 | 10/1961 | Purinton | 339/262 |
| 3,538,491 | 11/1970 | Longenecker | 339/256 |
| 4,148,547 | 4/1979 | Otsuki et al. | 439/843 |
| 4,685,761 | 8/1987 | Locati | 439/843 |
| 4,715,833 | 12/1987 | Mobley et al. | 439/834 |
| 4,734,064 | 3/1988 | Knapp et al. | 439/852 |
| 4,780,097 | 10/1988 | Piscitelli | 439/843 |
| 4,934,964 | 6/1990 | Mazelle | 439/843 |

*Primary Examiner*—David L. Pirlot
*Attorney, Agent, or Firm*—Francis J. Fodale

[57] ABSTRACT

An electrical female terminal of one piece construction comprises a contact portion at one end and an attachment portion at an opposite end for attaching the terminal to an electric cable. The contact portion includes a split socket and a pair of integrally attached, longitudinal contact arms that are disposed inside the split socket. The longitudinal contact arms have rearward abutting plates that have flanges that engage the inside surface of the socket to provide a solid anchor for the longitudinal contact arms to extend forwardly in cantilever fashion. The longitudinal contact arms have diverging medial portions and converging forward portions that provide deflectable contact fingers for engaging opposite sides of a pin terminal when it is inserted into the socket.

5 Claims, 2 Drawing Sheets

ELECTRICAL FEMALE TERMINAL

BACKGROUND OF THE INVENTION

This invention relates generally to electrical female terminals and more specifically to electrical female terminals that are attached to electric cables for use in sealed electrical connectors of the "plug through" type disclosed in U.S. Pat. No. 4,946,402 granted to Randy L. Fink and Bruce J. Serbin Aug. 7, 1990.

This patent discloses a "plug through" type sealed electrical connector that has an elastomeric seal that is mounted on the cable end of a connector body before the electrical female terminals that are attached to the ends of electric cables are installed. These electrical female terminals are inserted into terminal cavities of the connector body through aligned holes in the elastomeric seal, that is, the electrical female terminals are "plugged through" the seal. The holes are sized to fit tightly around the electric cables when the electrical female terminals are installed so as to seal the cable end of the electrical connector.

It is already known to provide electrical female terminals of two piece construction for these "plug through" arrangements comprising a main terminal member and a protective can of hood. In these known terminals, the main terminal member has spring contact fingers at one end and crimp means at the other end to attach the main terminal member to the end of an electric cable. The protective can or hood surrounds the spring contact fingers to protect the fingers and provide a round, protrusion free contact end that facilitates the electrical female terminals being pushed through tight holes in the elastomeric seal during installation.

This two piece terminal is expensive to manufacture because of poor material utilization and slow manufacturing processes. Two strips of stock are required and the assembly speed is limited to 200 parts per minute. Quality control and inspection are also difficult because contact plating is not accessible.

It is also known from U.S. Pat. No. 3,538,491 granted to Bruce C. Longenecker, Armond R. de Lyon and Lex. D. Kensinger Nov. 3, 1970 to provide an electrical pin receptacle PR of one piece construction.

This pin receptacle comprises a spring contact assembly (7) that is inside a barrel member (12). The spring contact assembly (7) and the barrel member (12) are integrally attached to each other by an extension (2) that is reversely bent upon itself.

This design reduces construction costs because of its one piece construction. However, the pin receptacle PR is not suitable for a sealed electrical connector of the "plug through" type described above because the pin receptacle PR does not have any provision for attaching the pin receptacle PR to an electric cable. Moreover, the pin receptacle PR does have a round, protrusion free contact end that would facilitate the pin receptacle being pushed through a tight hole in an elastomeric seal easily. This is due primarily to the presence of flared mouth (11) and cooperating ears (13) that provide stop means to limit the movement of the pin receptacle PR within a hole of a printed circuit board of carrier member.

It is also known from U.S. Pat. No. 4,715,833 granted to Dewey F. Mobley and Janice M. Warren Dec. 29, 1987 to provide an electrical socket member (14) that has a split socket section (34) that is provided with three equally spaced, inwardly directed ribs (40). The ribs (40) firmly engage the outer surface (46) of a pin member (16) when it is inserted into the tubular section (34).

The electrical socket member (14) is also of one piece construction. However, it has several drawbacks. For instance, the ribs (40) are non-compliant contacts and consequently the socket member (14) has high engagement force characteristics, tight tolerance requirements, high contact stress and little tolerance for misalignment of the pin terminal (12). Moreover the socket member (14) has a pin receiving receptacle that includes a conic support section (57) that has a 180 degree opening (54) which provides the necessary resilience for the split socket section (34) to receive the pin terminal (12). This opening exposes sharp edges that make the socket member (14) unsuitable for use in a sealed electrical connector of the "plug through" type. In addition, the non-compliant contacts in the form of inwardly directed ribs (40) require a guide section (38) which is difficult to form. This limits the choice of materials for the socket member (14) and also diminishes the suitability of the socket member (14) for a sealed electrical connector of the "plug through" type. Furthermore, the pin receiving receptacle of the socket member (14) has a split socket section (34) that is structurally supported on an enlarged tubular section (55) that would limit the use of the socket member (14) to large diameter electric cables in a "plug through" seal arrangement.

SUMMARY OF THE INVENTION

The object of this invention is to provide an improved electrical female terminal of one piece construction.

Another object of this invention is to provide an improved electrical female terminal of one piece construction that can be attached to an electric cable for use in a sealed electrical connector of the "plug through" type.

A feature of the invention is that it has compliant contact which provide several advantages including an increased dimensional tolerance to achieve a desired contact force range, low contract stress which avoids problems of stress relaxation and considerable tolerance for misalignment of the making pin terminal.

Another feature of the invention is that the compliant contacts are protected inside a round, protrusion free cylindrically shaped socket that facilitates the terminal being pushed through a tight hole of a seal without damaging the seal.

Still another feature of the invention is that the cylindrically shaped socket has a guide that is easy to form.

Yet another feature of the invention is that the cylindrically shaped socket does not have any enlargements or sharp edges that inhibit use of the terminal in a sealed electrical connector of the "plug through" type.

Still yet another feature of the invention is that the contacts may be formed from preplated stock having a band of plating that is exposed to facilitate quality control and inspection.

Other objects and features of the invention will become apparent to those skilled in the art as disclose is made in the following detailed description of a preferred embodiment of the invention which sets forth the best mode of the invention contemplated by the inventors and which is illustrated in the accompanying sheet (s) of drawing.

DETAILED DESCRIPTION OF THE PREFERRED EMBODIMENT

Figure 3:
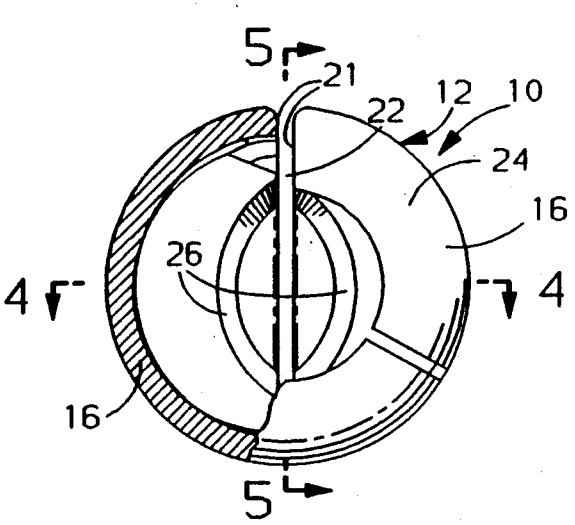
FIG. 3 is a partially sectioned front view of the electrical female terminal taken substantially along the line 3—3 of FIG. 2 looking in the direction of the arrows.
Figure 1:
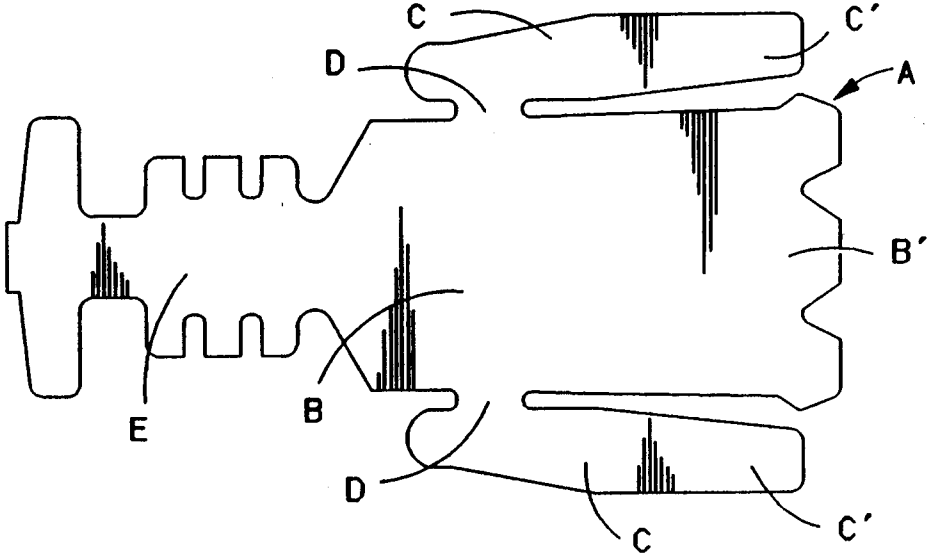
FIG. 1 is a plan view of the flat blank for making an electrical female terminal of one piece construction in accordance with this invention.

Referring now to the drawing, the plan view of a flat metal blank for making an electrical female terminal in accordance with this invention is shown in FIG. 1. The blank comprises a forward contact portion A which includes a generally rectangular part B that is rolled to form a split, cylindrically shaped socket. The forward contact portion A also includes two strips C that are attached to opposite longitudinal edges of the rectangular part B by short narrow has D that are located near the rearward end of rectangular part B. The strips C are bent to form two longitudinal contact arms that are disposed inside the socket that is rolled from the rectangular part B. The blank further includes a rearward winged part E that is formed into crimp wings for attaching the terminal to an electric cable.

If desired the blank portions B′ of rectangular part B and blank portions C′ of strips C may be plated with a highly electrically conductive material such as gold easily before the blank is formed. The plating is exposed after the forming process and consequently quality control and inspection of the plating is facilitated.

Figure 2:
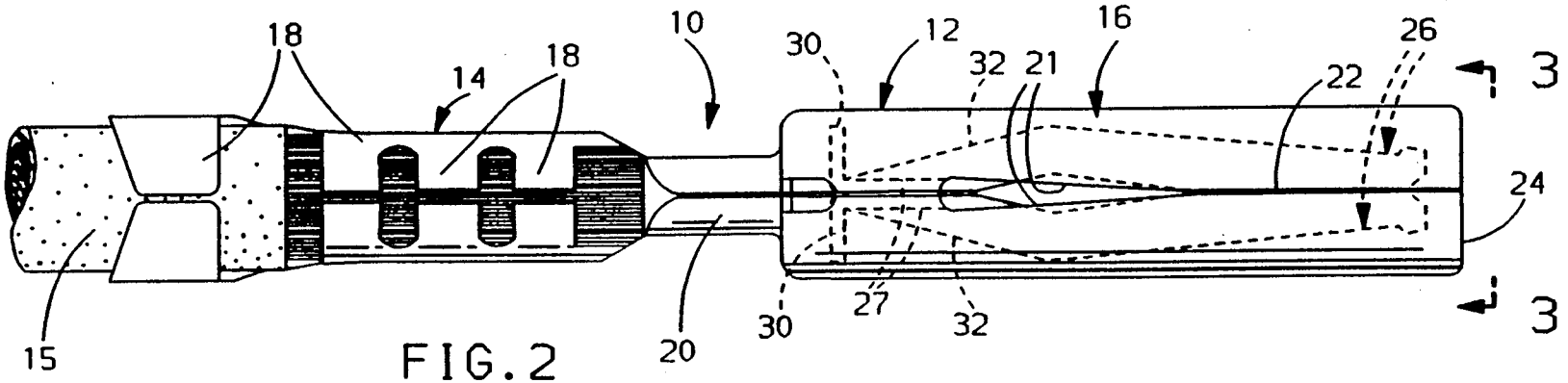
FIG. 2 is a longitudinal top view of an electrical female terminal in accordance with the invention made from the flat blank of FIG. 1.

FIGS. 2–6 illustrate an electrical female terminal (10) of one piece construction in accordance with this invention that is made form the flat blank shown in FIG. 1. The terminal (10) is made of a suitable electrically conductive material, preferably a relatively soft copper alloy. It comprises a contact portion (12) at open end and an attachment portion (14) at the opposite end for attaching the terminal to an electric cable (15) as best shown in FIG. 2.

The contact portion (12) includes a split, cylindrically shaped socket (16) that is attached to crimp wings (18) of the attachment portion (14) by an intermediate split, cylindrically shaped neck (20) of reduced diameter. The socket (16) has a pair of longitudinal edges (21) that define a longitudinal split (22) when the socket (16) is rolled into a cylinder from the generally rectangular part A of the flat blank that is shown in FIG. 1. The socket (16) also has an annular, inwardly curled lip (24) at its front end that defines an entrance for plugging a mating terminal pin (not shown) into the socket (16).

The contact portion (12) further includes a pair of longitudinal contact arms (26) that are formed from the strips C and disposed inside the socket (16). The contact arms (26) are integrally attached to the respective longitudinal edges (21) of the socket (16) by short support tabs (27). The support tabs (27) are located near the rearward end of the socket (16) and are formed by bending the short, narrow blank tabs inwardly as the socket (16) is being formed.

Figure 4:
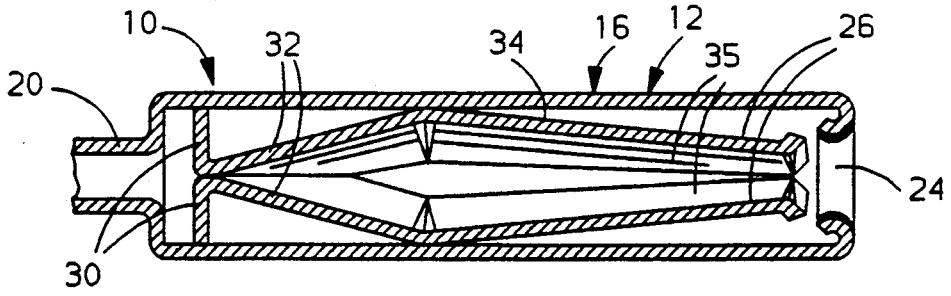
FIG. 4 is a longitudinal section of the electrical female terminal taken substantially along the line 4—4 of FIG. 3 looking in the direction of the arrows.
Figure 5:
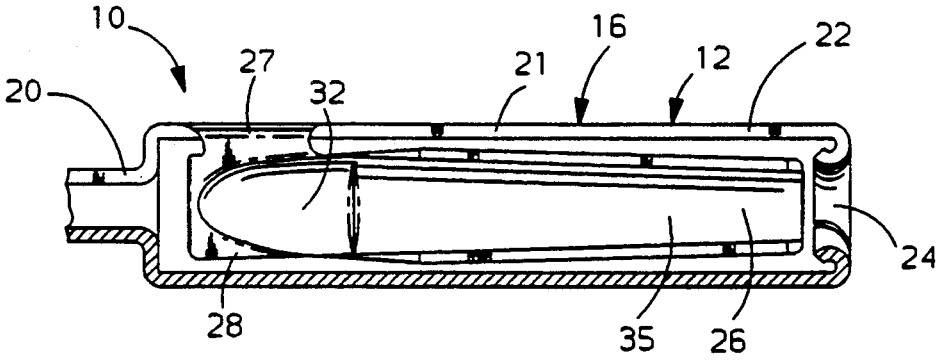
FIG. 5 is a longitudinal section of the electrical female terminal taken substantially along the line 5—5 of FIG. 3 looking in the direction of the arrows.

The longitudinal contact arms (26) are in a generally diamond shaped arrangement, as best shown in FIG. 4, comprising rearward plates (28) that are attached to the respective inwardly bent support tabs (27). The rearward plates (28) are juxtaposed and preferably abut each other. Each rearward plate (28) has a perpendicular, semi-circular flange (30) at its rearward edge end that engages the inside surface of the socket (16) rearwardly of the support tabs (27). This tab, plate and flange arrangement provides a solid anchor for the longitudinal contact arms (26) that extend forwardly in cantilever fashion.

Figure 6:
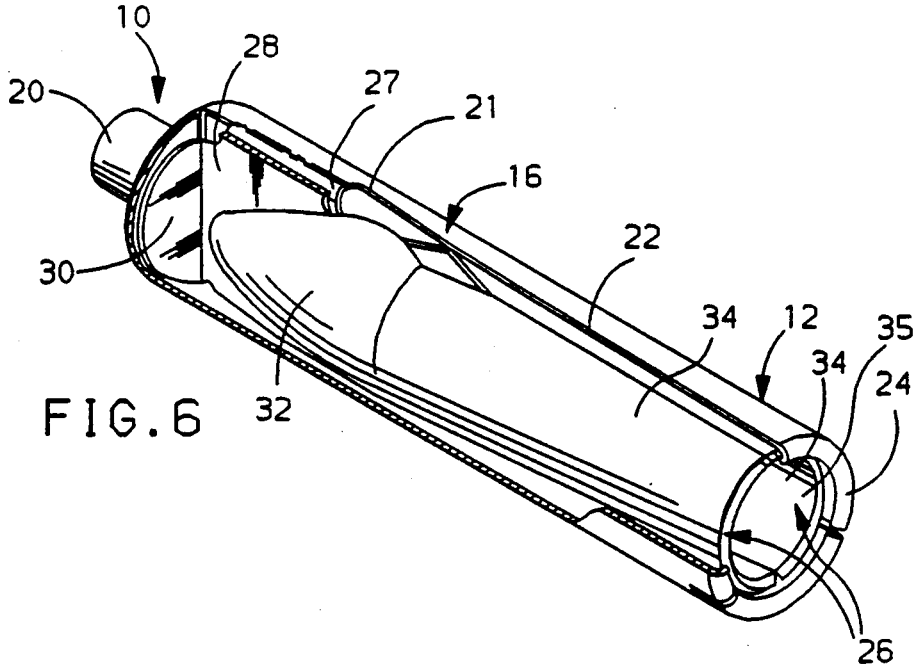
FIG. 6 is a perspective view of the electrical female terminal that is partially broken away to show internal detail.

The longitudinal contact arms (26) further comprise medial diverging portions (32) of arcuate cross section that are partially formed out of the rearward plates (28). These medial diverging portions (32) preferably engage the inside surface of the socket (16) forwardly of the support tabs (28) as best shown in FIGS. 4 and 6. This provides even further support for deflectable contact fingers (34) that are provided by forward converging portions of the longitudinal contact arms (26) that are also of arcuate cross section. These deflectable contact fingers (34) biasingly engage opposite sides of a mating pin terminal (not shown) when it is inserted into the socket (16) through the entrance formed by the inwardly curled lip (24). The tips of the deflectable contact fingers (34) are flared outwardly to guide the pin terminal into the space between the deflectable contact fingers (34).

Thsu, the electrical female terminal (10) provides a relatively inexpensive terminal of one piece construction that has the advantages of compliant contacts in a configuration that is well suited to use in a sealed electrical connector of the "plug through" type.

Also, as indicated earlier the inward confronting surfaces (35) of the contact fingers (34) can also be plated with gold or other highly electrically conductive material easily.

I wish it to be understood that I do not desire to be limited to the exact details of construction shown and described, for obvious modifications will occur to a person skilled in the art.

I claim:

1. An electrical female terminal of one piece construction comprising:

a contact portion at one end and an attachment portion at an opposite end for attaching the terminal to an electric cable;

the contact portion including a split socket that is attached to the attachment portion by an intermediate neck of reduced diameter;

the split socket having a pair of longitudinal edges defining the split and a curled annular lip at its front end defining an entrance for plugging a mating terminal pin into the split socket;

the contact portion further including a pair of longitudinal contact arms that are disposed inside the split socket and that are integrally attached to the respective longitudinal edges of the split socket by inwardly bent support tabs that are located near its rearward end;

the longitudinal contact arms having rearward plates that abut each other an that each have a perpendicular, semi-circular flange at its rearward end that engages the inside surface of the socket rearwardly of the support has to provide a solid anchor for the longitudinal contact arms to extend forwardly in cantilever fashion;

the longitudinal contact arms having diverging medial portions of arcuate cross section that engage the inside surface of the socket forwardly of the support tabs; and the longitudinal contact arms having converging forward portion of arcuate cross section that provide deflectable contact fingers for engaging opposite sides of a pin terminal when it is inserted into the socket.

2. The electrical female terminal as defined in claim 1 wherein the contact fingers have inward confronting surfaces that are placed with a highly electrically conductive material.

3. An electrical female terminal of one piece construction comprising:

a contact portion at one end and an attachment portion at an opposite end for attaching the terminal to an electric cable;

the contact portion including a split socket having a pair of longitudinal edges defining the split and an annular lip at its front end defining an entrance for plugging a mating terminal pin into the split socket;

the contact portion further including a pair of longitudinal contact arms that are disposed inside the split socket and that are integrally attached to the respective longitudinal edges of the split socket by inwardly bent support tabs that are located near its rearward end;

the longitudinal contact arms having means at their rearward end that engage the inside surface of the socket rearwardly of the support tabs to provide a solid anchor for the longitudinal contact arms to extend forwardly in cantilever fashion;

the longitudinal contact arms having diverging medial portions for engaging the inside surface of the socket; and the longitudinal contact arms having converging forward portions that provider deflectable contact fingers for engaging opposite sides of a pin terminal when it si inserted into the socket.

4. An electrical female terminal of one piece construction comprising:

a contact portion at one end an attachment portion at an opposite end for attaching the terminal to an electric cable;

the contact portion including a split socket having a pair of longitudinal edges defining the split, and an entrance at its front end for plugging a mating terminal pin into the split socket;

the contact portion further including a pair of longitudinal contact arms that are disposed inside the split socket and that have rearward portions that are integrally attached to the respective longitudinal edges of the split socket by inwardly bent support tabs that are located near its rearwardly end;

the longitudinal contact arms extending forwardly of the support tabs in cantilever fashion and having diverging medial portions that extend toward the inside surface of the socket in a forward direction; and the longitudinal contact arms having converging forward portions that provide deflectable contact fingers for engaging opposite sides of a pin terminal when it is inserted into the socket.

5. The electrical female terminal as defined in claim 4 wherein the contact fingers have inward confronting surfaces that are plated with a highly electrically conductive material.

* * * * *

UNITED STATES PATENT AND TRADEMARK OFFICE

CERTIFICATE OF CORRECTION

PATENT NO. : 5,186,663

DATED : February 16, 1993

INVENTOR(S) : Mark J. Vanden Wymelenberg

It is certified that error appears in the above-identified patent and that said Letters Patent is hereby corrected as shown below:

On the title page, item [75]:

The inventor's name should read "Mark J. Vanden Wymelenberg" instead of -- Mark J. V. Wymelenberg --.

Signed and Sealed this

Nineteenth Day of April, 1994

Attest:

Bruce Lehman

BRUCE LEHMAN

Attesting Officer

Commissioner of Patents and Trademarks